US011786437B2

(12) United States Patent
Martinez Millet

(10) Patent No.: US 11,786,437 B2
(45) Date of Patent: Oct. 17, 2023

(54) MASSAGE DEVICE

(71) Applicant: Lourdes Maria Martinez Millet, Lima (PE)

(72) Inventor: Lourdes Maria Martinez Millet, Lima (PE)

( * ) Notice: Subject to any disclaimer, the term of this patent is extended or adjusted under 35 U.S.C. 154(b) by 409 days.

(21) Appl. No.: 17/031,287

(22) Filed: Sep. 24, 2020

(65) Prior Publication Data

US 2022/0062089 A1 Mar. 3, 2022

(30) Foreign Application Priority Data

Sep. 1, 2020 (PE) ..... 001332-2020/DIN

(51) Int. Cl.
*A61H 7/00* (2006.01)
*A61H 11/00* (2006.01)

(52) U.S. Cl.
CPC ..... *A61H 7/003* (2013.01); *A61H 11/00* (2013.01); *A61H 2201/1253* (2013.01); *A61H 2201/1695* (2013.01)

(58) Field of Classification Search
CPC ..... A61H 7/003
USPC ..... D24/211–215
See application file for complete search history.

(56) References Cited

U.S. PATENT DOCUMENTS

| | | | | | |
|---|---|---|---|---|---|
| 4,590,926 | A * | 5/1986 | Courtin | A61H 7/003 601/134 |
| D868,279 | S * | 11/2019 | Chiu | D24/214 |
| 2014/0213944 | A1 * | 7/2014 | Kojima | A61H 7/003 434/262 |
| 2019/0008716 | A1 * | 1/2019 | Giddings | A61H 7/003 |

FOREIGN PATENT DOCUMENTS

| | | | | |
|---|---|---|---|---|
| CN | 2855401 | Y | 1/2007 | |
| CN | 203226397 | U | 10/2013 | |
| CN | 204208007 | U | 3/2015 | |
| KR | 20210003015 | A * | 1/2021 | A61H 39/04 |
| WO | WO-2006017958 | A1 * | 2/2006 | A61H 7/003 |
| WO | WO-2010131108 | A2 * | 11/2010 | A61H 37/00 |

* cited by examiner

*Primary Examiner* — Samchuan C Yao
*Assistant Examiner* — Tina Zhang
(74) *Attorney, Agent, or Firm* — Hoglund & Pamias, PSC; Roberto J. Rios

(57) ABSTRACT

This massage device is used as a tool to treat face and neck skin and employs scraping massage to improve blood circulation, skin elasticity, as well as to help treat wrinkles and sagging skin and even achieve a facelift effect. The massage device includes of a combination of curved-convex and curved-concave sections in their layout, where a tulip shape is predominant, which allows to access every particular area of the face and neck in a comfortable and thorough manner, which in turn comprises a symmetrical configuration with respect to a central longitudinal axis that divides the body and allows the user to handle the device from different sides, and where a tapered perimeter edge with a blunt finish also allows for a comfortable and adjustable grip on the user's palm.

6 Claims, 3 Drawing Sheets

MASSAGE DEVICE

FIELD OF THE INVENTION

This invention belongs in the field of non-invasive medical devices for body treatment based on skin stimulation, especially by means of massage. It uses a tool which comes in contact with the skin, and most particularly, it refers to a massage device, fit for the treatment of both face and neck.

BACKGROUND OF THE INVENTION

Nowadays, our hectic lifestyles force us to adopt habits and routines which allow us to deal with the ageing process in our bodies; thus, eating healthily and replacing unhealthy habits with healthy ones have become health trends ruling our behavior; among those, daily skin care, especially involving the face and neck, overexposed to sunlight and the environment on a daily basis, take center stage as they are a necessary tool to counteract the negative effects of ageing.

These days there is a wide variety of massage devices, from the rubbing roller type to those including brushes for skin treatment, from manual to electric, all of which aim to improve blood circulation, alleviate stress and relax muscles, apart from strengthening facial skin and muscles to improve their firmness and reduce signs of fatigue.

In that sense, body treatments have experienced continued evolution and have been influenced by a number of trends, most of which are Eastern.

One of those Eastern trends has taken elements from an ancient Chinese technique based on vigorously scraping the skin to draw the body's energy up to a few centimeters from the surface of the skin, where wei chi (the body's defensive energy or immune system) is located. This procedure is based on the principle that when the body's defensive energy levels are low, diseases enter the body and cause damage and energy stagnation, thus affecting the body's dynamic balance.

As far as this technique has been used mainly as a tool to treat an array of physical ills, it is only recently that the same tools used in it have been used in the treatment of more specific areas of the body. It is only those uses that have been adapted to these new requirements, not their shapes. Then, even though it is understood a neck and face massage must be done gently, certain special scraping techniques are needed to adequately complete the routines; nevertheless, once this massage concept became popular, traditional techniques have become lost, which has resulted in inexperienced and—many times—inadequate use of the scraping procedure, causing bruising due to trauma, dermatitis, redness of the skin and other resulting issues.

According to Clive Whitham, who wrote "The Book of Oriental Medicine", in the traditional method, the skin is scrapped with a rounded tool to cause certain changes in surface tension of the connective tissue; once this tension has shifted, the tissue releases blood cells to the skin surface, thus causing small red dots to appear on the skin; this method can be used on the face to smooth out wrinkles and fine lines, and on the neck and shoulders to release tension and, in general, to tone the body. The basic tool kit for treatment consists of a Chinese soup spoon and buffalo horn utensils, whose edges have to be rounded and smooth. Even though the treatment has been used for hundreds of years in the Far East, in our experience, it is completely unknown to most Westerners, especially regarding its treatment techniques.

In general, one of the problems encountered is that, due to the fact that the traditional treatment of massaging and scraping needs to meet relatively high technical requirements, it has to be carried out by professionals, as they have to work directly on the skin in a safe, hygienic and adequate environment. Nevertheless, notwithstanding its usefulness or proven efficacy, precisely because this is a trend or fad and, in view of the amount of time and money it would require to seek a specialist in this treatment, lately a number of tools have emerged, which act as scraping massagers, and are sold for home use. This development has provided people with a tool, which varies in shape and size, but which is generally destined for use all over the body, with the implied health risks that if not used properly; that is. if the massage is applied by an inexperienced person, it will probably have no effect or could even bring about lymphatic circulation problems, or other skin-related conditions.

Thus, we are aware of the prior art, thanks to document CN2855401 (Y), which describes a multifunctional therapeutic and sanitary scraping plate consisting of a triangular plate, a ball and a steel needle, where the three sides of the plate feature concave and convex arches of different depths to allow for scraping and massaging different parts of the body. Two out of the three vertices have large or small ball-shaped fitted elements to massage the relevant acupuncture points, while the third vertex includes a hidden steel needle, which emerges firmly when used to stimulate the nerves located in acupuncture points. As can be understood, this triangular layout with a needle element in one of the vertices of the previously mentioned device has a disadvantage owing precisely to its shape, since, as mentioned before, apart from being a tool that can be used on any part of the body, if incorrectly used, it can damage the skin on both face and neck.

For its part, document CN204208007 (U) describes a therapeutic massage device which has a titanium layer, where the main body consists of a griping part and a scraping part, and the latter is arranged around the outer edge of the gripping part. This tool can be used to massage muscles and acupuncture points on different parts of the body and is not specifically intended for use on the face and neck; and, even though it is mentioned by the technical document, the titanium alloy material present in the device can promote blood circulation, its hardness and particular shape could, in the hands of an unskilled operator, cause the scraping process to damage such areas.

Finally, document CN203226397 (U) describes a multifunctional horn comb consisting of a triangular shaped comb as a main body, where there are: 1.comb teeth on one side of the body; 2. an arc-shaped scraping handle ending in a protruding curved scraping end, and, 3. on the opposite side, there is a concave cervical massage part, so that on both sides of the cervical massage part, there are protruding arch acupuncture parts. As much as this device has a curved layout, it does not possess ergonomic features which would allow its user to comfortably handle it and, having a limited number of usable portions, it does not adequately reach every face and neck area so as to fit into those zones and allow for a type of treatment, where controlled strength can be applied to prevent damage to the skin in case the tool is held by an unskilled user It is evidently clear that there is need for: A. improvement of massage devices of the scraping kind applied on the area of interest and, B. achievement in the manufacture of a specific tool for use on face and neck, which would be available for a target audience, inexperienced, untrained in the application of scraping massage treatments so that they can perform them in a safe and effective way. These devices have to consist of a one-piece body that is firm and stable enough to be used without the need to apply excessive force, and a structure which allows for easy recognition of a specific use for every one of the different, yet clearly defined areas of the face and neck, thus providing the user with comfort, safety and maneuverability at all times.

SUMMARY OF THE INVENTION

In general, the purpose of this invention is to provide a massage device able to solve the problems posed by the above-mentioned technique.

This way, an aspect of this invention is to provide a massager that could be used as a tool, mainly for face and neck skin care, but which could also be used as a scraping massage device to improve blood flow, promote skin elasticity, help treat wrinkles and sagging skin, and even achieve a facelift effect.

Another aspect of this invention is to act as a massage device which can be used as an appliance which does not need for a professional to handle it, which makes it fit for use by an untrained user; this way, it would not be constricted by time or space either.

A third aspect of this invention is to provide a massage device which main features combine curved-convex and concave sections in its layout which allow it to access every part of the body in a comfortable, thorough manner, enabling uniform and continuous traces, so that thanks to its different curvatures, it is able to fit into any body area to treat and completely occupy it.

A fourth and final aim of this invention is to offer a massage device which features comfortable and flexible use for the person who manipulates it; this is thanks to a body where the curved-convex and concave sections of its layout are symmetrical with respect to a central longitudinal axis which divides such body and allows the user to manipulate the device from different sides/angles, enabling them to comfortably massage the left and right sides of the body, as well as allowing them for proper coordination of the left and right hands; and where the one-piece body presents a thinning of its cross-sectional area close to the edge around its total perimeter, allowing the user comfortable and adjustable grip on the palm.

Thus, in order to achieve the objectives outlined above, this invention presents a massager device consisting of a body of elongated and symmetrical layout with respect to a central longitudinal axis, where a first curved-concave longitudinal side is smooth, and a second curved-concave opposite side has a comb-like scraping section towards the middle of the side, which allows to have two combinations of scraping surfaces—smooth/comb, or smooth/smooth—and which can be used according to the user's needs, be it to activate blood circulation, warm up connective tissue and help to reduce inflammation in adipose tissue, as well as to promote skin elasticity, smooth fine lines generated by fascia contracture, shake muscles and relax and loose facial muscles that have contractured over time and keep having the same aspect, all of which is achieved thanks to the comb, which provides deeper massage by allowing for the small irregular aspect of contractured skin to settle down on the bumps and valleys of the comb; moreover, both sides are connected by a first end composed of three protruding curved-convex portions, and a second opposite end having two equally protruding curved portions, so that the curved-concave portions formed have different depths to fit a specific area of the face or neck in the first place, but are still adaptable to the rest of the body; and where the body of the device has a tapered perimeter edge ending in a blunt finish.

This way, the massager or massaging invention is tulip-shaped, which makes for a convenient, delicate and adaptable symmetry for the user, where in a particular embodiment, the body is located on a base measuring between 11.8 and 12.3 cm long and between 6.5 and 7.0 cm wide, will have different curved portions so that the curved-concave portions on the first end are less deep than the curved-concave portions on the second end, and the latter is, in turn, also less deep than the curved-concave portions on the longitudinal sides. This way, in this particular embodiment example, the curved-concave portions on the first end are 0.3 cm deep and 0.8 cm deep on the second end, while the curvature on both lateral sides is 2.0 cm deep. It is understood that the described dimensions are merely given for illustrative purposes and are not intended to limit the device proportions or size to a unique one, but are there to illustrate the differences in in the curvatures needed to achieve the main aim of this invention, which is, to adapt to the different body surfaces and even to the different body sizes of those who would need to use this developed device.

Likewise, different materials could be contemplated for the manufacture of the scraping tools, such as bian stone, jade, resin, rose quartz, agate, green aventurine, where every material performs a different function. For instance, not limiting them to the materials used or preferred, (black) bian stone is considered to have healing powers promoting ultrasonic pulse when in touch with the skin to improve skin micro circulation and metabolism; strengthening the immune system and internal organs. It is used in Chinese medicine to treat several illnesses, mainly pain in the neck, back and migraine; while white jade helps promote inner peace, orients energy in a more constructive, decision-making direction when important information is shown. White minerals provide fulfillment and perfection and promote self-awareness.

BRIEF DESCRIPTION OF THE FIGURES

Here is a detailed explanation of the massage device invention in particular embodiment example, which does not mean to limit its design, but merely to illustrate the principle achieved in a scraping massage tool which adequately adapts to the different areas of the body, specifically the face and neck, on which it works offering comfortable maneuverability to the user, as represented by the figures

DETAILED DESCRIPTION OF THE INVENTION

Figure 1:
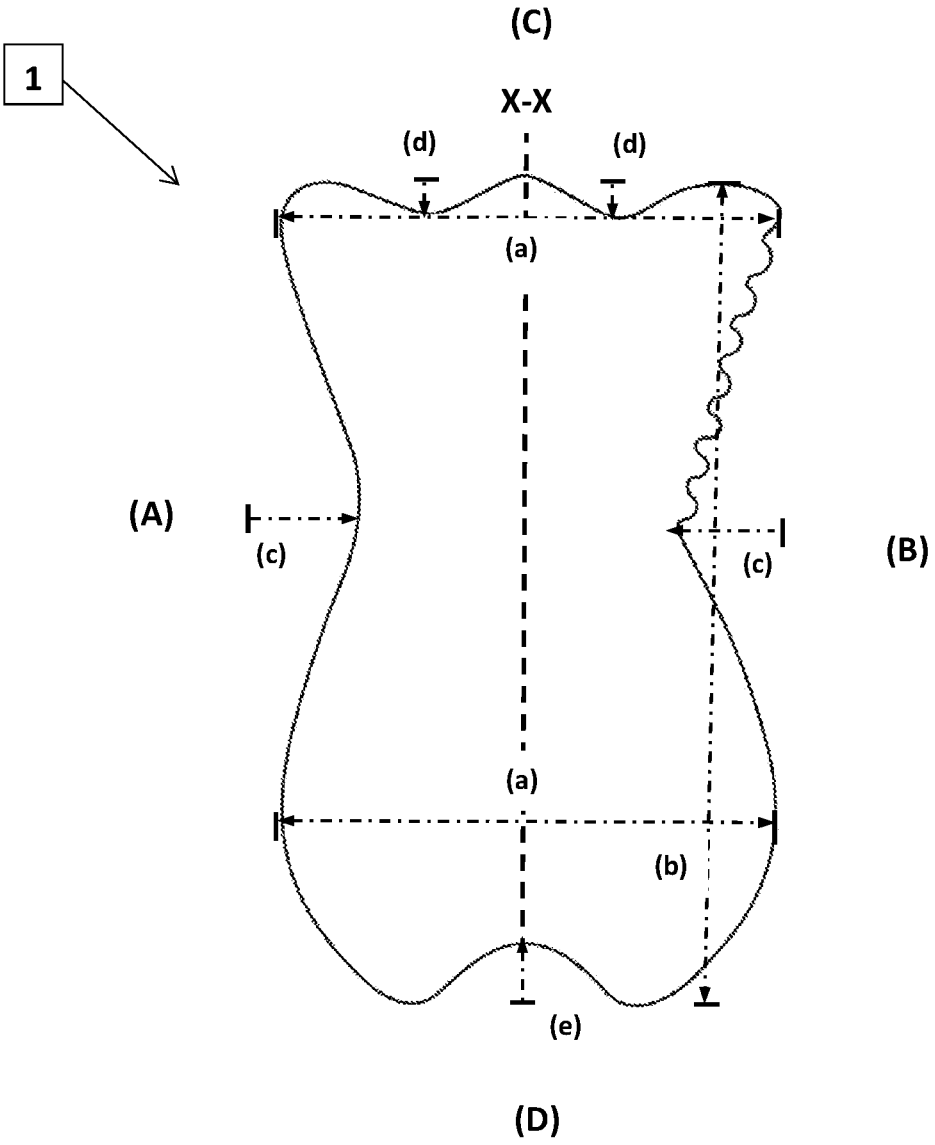
FIG. 1: shows a plan view of the massage device, according to the invention.

According to a particular embodiment example of the present invention, we can see from FIG. 1, a plan view of the massager device, which displays a one-piece tulip-shaped body thanks to the combination of predominantly curved-convex and curved-concave sections in its layout and where the body (1) has a symmetrical configuration with respect to an X-X central longitudinal axis.

On this extended body (1), we can see a first curved-concave longitudinal side (A), which is smooth and features a lateral scraping section, and a second opposite longitudinal side which defines a lateral scraping curved-concave section (B), formed by an arrangement from a lateral scraping mid-section, a comb-like structure with small-rounded protruding portions and a smooth scraping lateral mid-section. The arrangement of the scraping smooth comb section thus set up, allows for a different kind of massage for when the area to work on needs decontracting or must be applied on connective tissue to help improve blood flow and lymphatic drainage, and help reduce inflammation in adipose tissues with the smooth lateral scraping section (A).

As can be seen, both lateral scraping sections are connected by a first end formed by three protruding curved-convex portions with rounded ends that open outward from the body (1) and its two corresponding curved-convex portions, which define a first scraping end section (C); and by a second opposite end with two curved-convex portions with more tapered ends that close toward the center and outside the body (1) and its respective curved-concave portion, which define an second scraping end section (D);

in a way that the respective curved-concave portions formed have different depths that would allow them to adjust to specific areas of the body.

Additionally, we can see from FIG. 1 a model device (1), where the body features different curves and the first scraping end section (C) has some curved-convex portions (d) which are 0.3 cm deep; the second extreme scraping section (D) has a curved-concave portion (e) which is 0.8 cm deep; and regarding the first and second lateral scraping sections (A) and (B), their curved-concave portions (c) are 2 cm deep.

Figure 2:
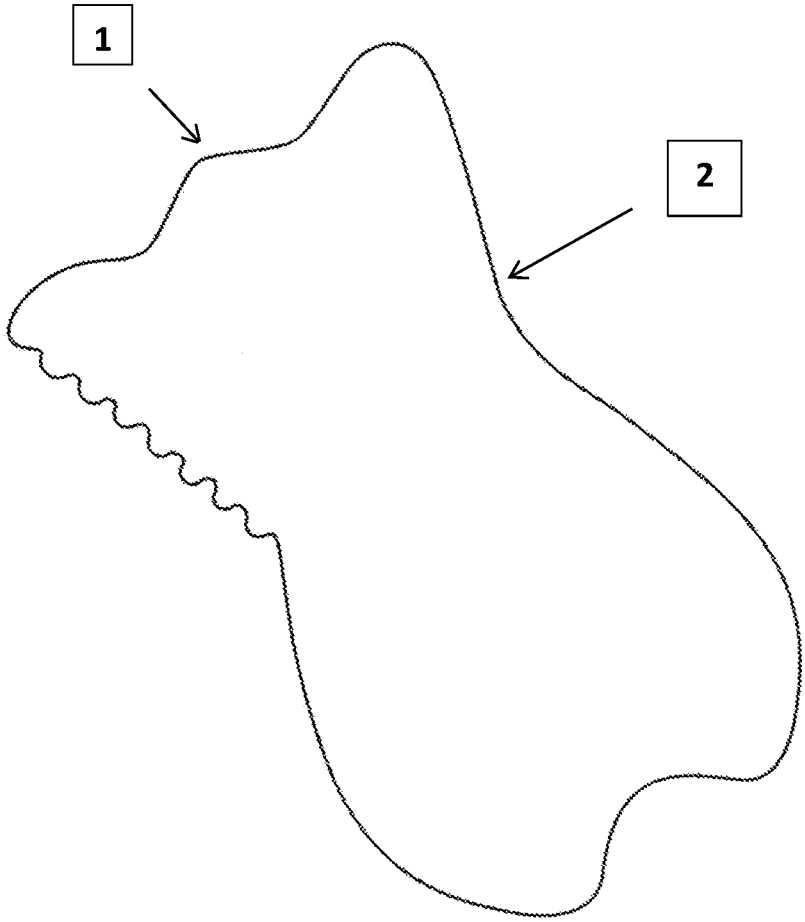
FIG. 2: shows a perspective view of the massage device from the development of the previous figure, according to the invention.

Moreover, the single-piece body (1) has a thinning in its cross-sectional area close to the edge, along its entire perimeter, which concludes in a blunt ending (2), as can be seen in FIG. 2.

Figure 3:
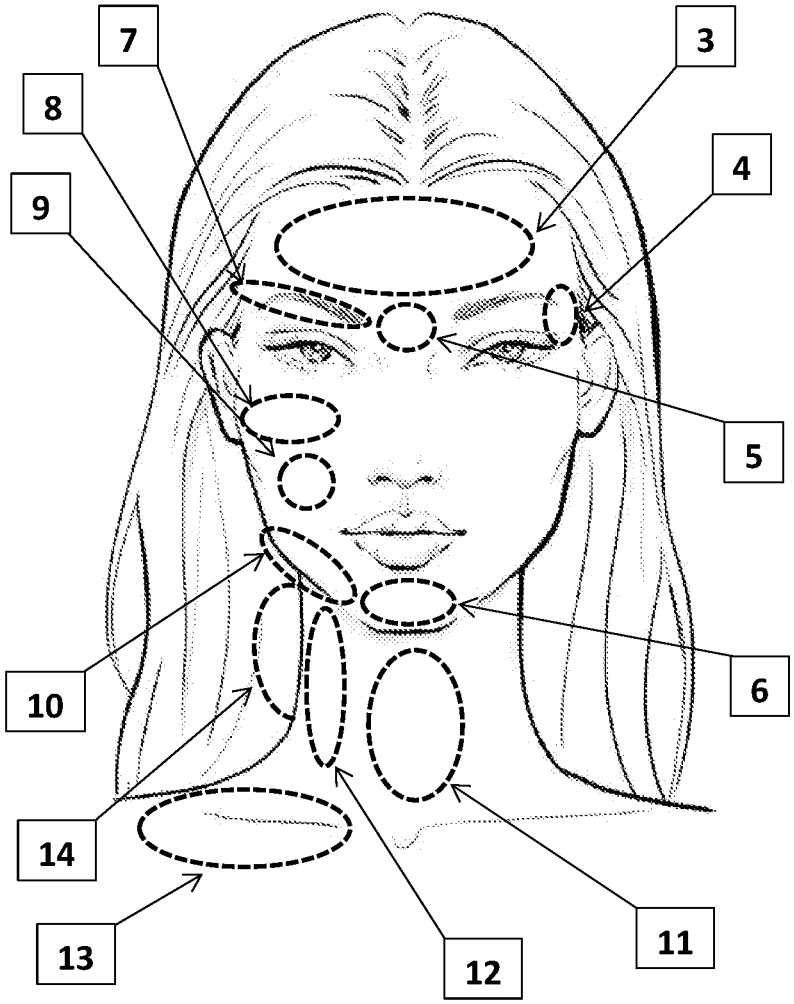
FIG. 3: shows and illustrated an example of the face and neck areas where the massage device fits into, according to the invention.

In FIG. 3, we exemplify a sample of the face and neck areas where the massage device could be used with adjustments, where every number represents a zone: (3) the forehead, (4) the temple, (5) the frown; (6) the chin; (7) the eyebrows and cicliary arch, (8) the cheekbones, (9) the cheek(s), (10) the jaw, (11) the central part of the neck, (12) the (lateral) side(s) of the neck, (13) the clavicle and (14) the upper cervical region.

Finally, other variations/modifications may be contemplated regarding dimensions, materials or other specifications for the manufacture or use of the described massage device, as long as this does not mean alteration of the essential features of the invention. For instance, and as a way to present a practical form of use of the developed massage device, we can point out that scraping section (A) could be adequately adjusted to the areas of the cheek (9), the lateral neck region (12) and the temple (4); while scraping section (B) could adjust to zones like the forehead (3), the temple (4), the frown (5) and the cheek (9); scraping section (C) would be adequate for the cheek (9), the lateral neck region (12) and the upper cervical region (14); scraping section (D) could adequately adapt to the eyebrows and ciliary arch (7), the clavicle (13); and scraping section (E) would adequately treat zones like the cheekbone(s) (8), the chin (6), the jaw (10) and the central part of the neck (11). Additionally, zones adequate for massage treatment are those that could be reached by the massager device, among which we can name the trapezium muscles and pectoral muscles, the armpit section of the chest, legs and arms, etc.

Use of the massage device, whose development has been described, is explained in an illustrative manner, without it being the only way to use it or a particular embodiment of use. In consequence, unlike ancient Chinese techniques where treatment involves repeated pressure shocks with a smooth edge placed against the previously oiled/lubricated skin surface, firmly pressed and then moved downward along the muscles or meridians, the aim of the massage device invented is to place part of it on its corresponding area of the face and neck, or generally, the body, where it would adequately fit, and from there, exercising light constant pressure, pull the device be it upward, to the right/left, to the left/right, always in a uniform way and in the same direction every time, keeping the device at an angle no greater than 30°, preferably no greater than 20° from the skin surface; which means looking to keep it as stuck as possible to the zone in treatment thus preventing skin damage, and cover the zone in treatment with a single pull, so that different pressures are not applied due to discontinuous sliding of the device over the area while the massage is being performed, releasing such pressure only at one end point of the treated area.

The invention claimed is:

1. A massage device comprising: a single-piece body with a layout including a plurality of curved-convex and curved-concave sections defining a first lateral section having a smooth scraping section; a second lateral section having a smooth scraping portion and a comb scraping portion adjacent to said smooth scraping portion; a first scraping end section; and a second scraping end section, wherein the shape of said first lateral section and said second lateral section define a symmetrical arrangement with respect to a central longitudinal axis of said single-piece body so that an end of said comb scraping portion adjacent to said first scraping end section is farther from said central longitudinal axis than an end of said comb scraping portion adjacent to the smooth scraping portion of said second lateral section.

2. The massage device of claim 1, wherein said curved-concave sections have different depths.

3. The massage device of claim 1, wherein said first scraping end section comprises three protruding curved-convex portions with rounded blunt ends arranged outwardly from the single-piece body.

4. The massage device of claim 1, wherein said second scraping end section comprises two curved-convex portions with rounded tapered ends arranged outwardly from the single-piece body.

5. The massage device of claim 1, wherein each of said first lateral section and said second lateral section include a curved-concave portion having a depth of 2 cm; said first scraping end section includes a curved-concave portions portion having a depth of 0.3 cm; and said second end scraping section includes a curved-concave portion having a depth of 0.8 cm.

6. The massage device of claim 1, wherein a cross-sectional area of an edge along an entire perimetry of said single-piece body is reduced ending in a blunt finish.

* * * * *